US007014427B1

(12) United States Patent
Hirota

(10) Patent No.: US 7,014,427 B1
(45) Date of Patent: Mar. 21, 2006

(54) CAPACITY CONTROLLER OF CAPACITY VARIABLE COMPRESSOR

(75) Inventor: Hisatoshi Hirota, Hachioji (JP)

(73) Assignee: TGK Co., Ltd., Tokyo (JP)

( * ) Notice: Subject to any disclaimer, the term of this patent is extended or adjusted under 35 U.S.C. 154(b) by 0 days.

(21) Appl. No.: 09/541,779

(22) Filed: Apr. 3, 2000

(30) Foreign Application Priority Data

Apr. 21, 1999 (JP) ..... 11-113035

(51) Int. Cl.
*F04B 49/00* (2006.01)

(52) U.S. Cl. ..... 417/218; 417/212; 137/625.64

(58) Field of Classification Search ..... 417/212, 417/218; 137/625.64; 418/29
See application file for complete search history.

(56) References Cited

U.S. PATENT DOCUMENTS 4,072,443 A * 2/1978 Heath ..... 417/218
4,730,986 A 3/1988 Kayukawa et al. ..... 417/222
4,886,425 A 12/1989 Itahana et al. ..... 417/309
4,932,843 A * 6/1990 Itoigawa et al. ..... 417/222
5,000,666 A * 3/1991 Esaki ..... 417/222
5,056,990 A * 10/1991 Nakajima ..... 417/295
5,145,326 A * 9/1992 Kimura et al. ..... 417/222.2
5,547,346 A * 8/1996 Kanzaki et al. ..... 417/222.2
5,588,807 A * 12/1996 Kimura et al. ..... 417/222.2

FOREIGN PATENT DOCUMENTS

| | | |
|---|---|---|
| CH | 257521 | 10/1948 |
| CH | A-257521 | 4/1949 |
| EP | 0 864 749 | 9/1998 |
| EP | A-0864749 | 2/2004 |
| EP | 1046818 B1 | 7/2004 |

* cited by examiner

*Primary Examiner*—Timothy P. Solak
(74) *Attorney, Agent, or Firm*—Patterson, Thuente, Skaar & Christensen, P.A.

(57) ABSTRACT

A small sized and structurally simple capacity controller having a wide control range of a compressor with variable capacity adds a differential pressure to an inhalation pressure on an arbitrary level by a piston valve body actuated by a solenoid and by the inhalation pressure. The differential pressure is transmitted into a capacity variation mechanism of the compressor in order to change the capacity of the compressor.

6 Claims, 7 Drawing Sheets

CAPACITY CONTROLLER OF CAPACITY VARIABLE COMPRESSOR

BACKGROUND OF THE INVENTION

The present invention relates to a capacity controller of a compressor with variable capacity used for a refrigerating cycle of an automobile air conditioner or the like.

DESCRIPTION OF THE RELATED ART

As the compressor in a refrigerating cycle of an automobile air conditioner directly is driven by the engine of the automobile the speed of the compressor cannot be controlled individually. In order to obtain proper refrigerating abilities without being limited by the engine speed compressors with variable capacity are used allowing to vary their capacity (the amount of discharged refrigerant) upon cooling or heating demand independent from the speed of the engine. The compressor may be a rotary compressor, a scroll compressor or a swash plate compressor. The capacity is controlled by controlling the inhalation pressure with the help of an energisation force brought onto a diaphragm by an electromagnetic solenoid. Due to said diaphragm also the pressure of the ambient air is applied. A capacity variation mechanism is controlled by the inhalation pressure. A capacity control mechanism having said diaphragm is complicated to operate, because the structure of the control mechanism is complicated and large in size, and because the available control range of the inhalation pressure is restricted. As a consequence, it is difficult, to control the compressor properly within a wide range of conditions.

OBJECTS AND SUMMARY OF THE INVENTION

It is an object of the present invention to provide a capacity control apparatus of a compressor with variable capacity which can be of compact size and structurally simple and which allows to obtain wide control range, and to propose a method for controlling the capacity of the compressor properly within a broader control range compared with the useable control range of only the inhalation pressure.

According to the invention a wide control range is obtained with a compact and small sized control apparatus having a simple configuration. This is achieved by controlling the capacity of the compressor with the help of a differential pressure added to the differential pressure port 28*c*. Differential pressure port 28*c* of controller 20 is connected to said other part of cylinder 31 on the side of piston 32 opposite to spring 33.

As a consequence, said control pressure Pc when controlled corresponds to the inhalation pressure Ps but is higher by an increment of pressure due to the thrust F caused by moveable iron core 23 (and the setting of springs 26, 27).

Discharge pressure duct is connected to a discharge pressure port 28*d* of controller 20. Discharge pressure port 28*d* (discharge pressure Pd) opens in the vicinity of valve seat 42 at the circumferential side of piston valve body 25, so that discharge pressure Pd does not affect the piston valve body 25 in axial direction, i.e., piston valve body 25 is pressure balanced for discharge pressure Pd.

Said valve closure jaw part 25*a* formed at the front end of piston valve body 25 serves to open and close said valve seat 42 between discharge pressure port 28*d* and differential pressure port 28*c*. As soon as said valve jaw part 25*a* is lifted from valve seat 42 during a movement of piston valve body 25 with thrust F pressure Pd from discharge pressure duct 2 is transmitted via the open valve seat 42 into differential pressure port 28*c*, according to the initial control condition of the controller.

Whenever the value of the pressure at the differential pressure port 28*c* becomes lower than the fixed value of control pressure Pc, piston valve body 25 is moved towards its opening state such that a communication is established between the discharge pressure port 28*d* and differential pressure port 28*c*. As soon as then the value of the pressure at the differential pressure port 28*c* reaches the fixed value of the control pressure Pc, piston valve body 25 returns into its closing state and again separates said differential pressure port 28*c* from said discharge pressure port 28*d*.

Furthermore, e.g. outside of controller 20, differential pressure port 28*c* and inhalation pressure port 28*s* are directly interconnected via a leak passage 40 having a small cross-sectional area, e.g. provided in a connection between inhalation duct 1 and a duct connecting differential pressure port 28*c* with mechanism 30. As soon as valve closure jaw part 25*a* closes valve seat 42 the value of the pressure at the differential pressure port 28*c* is allowed to little by little relieve via leak passage 40 into inhalation duct 1. As inhalation pressure on an arbitrary level with the help of a controlling piston valve body, loaded inter alia by a solenoid. Additionally, the inhalation pressure is applied to the piston valve body so that a value of the differential pressure can be maintained and set arbitrary for the transmission into the capacity variation mechanism to correspondingly adjust the capacity of the compressor. Basically, the differential pressure used in connection with the inhalation pressure is derived from a discharge pressure of the compressor allowing to broaden the pressure variation range for the capacity variation mechanism. The inhalation pressure remains the leading control parameter. However, not only the inhalation pressure and/or its pressure variations control the capacity variation mechanism, but in addition an assistant differential pressure is taken from the discharge pressure of the compressor and is added. The magnitude of the differential pressure may be adjusted and varied by a solenoid, e.g. a proportional solenoid.

BRIEF DESCRIPTION OF DRAWINGS

Embodiments of the invention will be described with the help of the drawings. In the drawings is.

DESCRIPTION OF THE PREFERRED EMBODIMENTS

Figure 1:
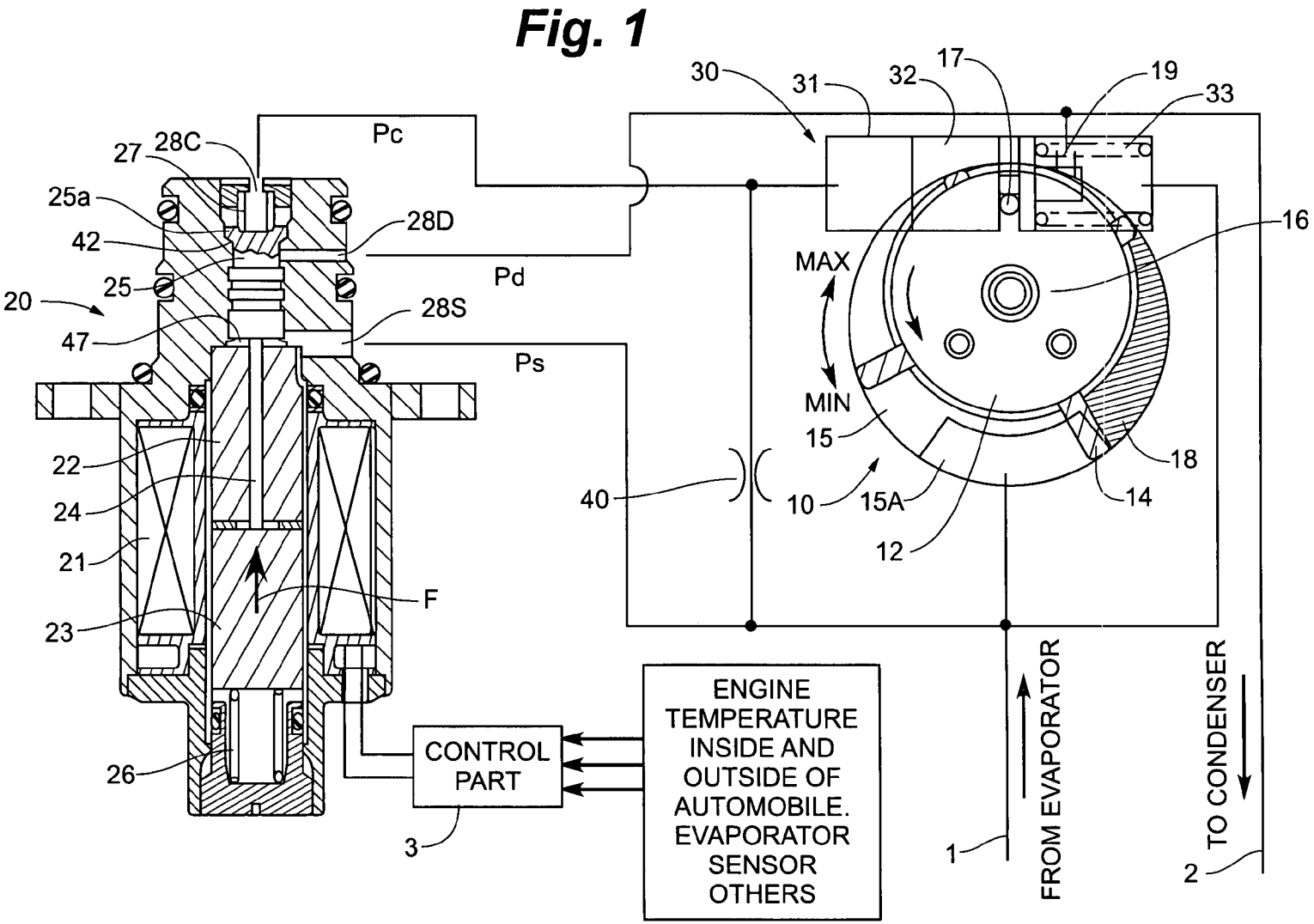
FIG. 1, sectional views of a capacity controller, a capacity variation mechanism and a rotary compressor integrated into a refrigerating cycle of an automobile air conditioning system, FIG. 2 a partial cross-section of the compressor shown in FIG. 1, FIG. 3 a partial cross-section of a detail of the compressor of FIG. 1, FIG. 4 a schematic view of the capacity variation mechanism of FIG. 1, FIG. 5 a view similar to FIG. 1, representing the condition of an adjustment of maximum capacity of the compressor, FIG. 6 a view similar to FIG. 1, representing a condition of minimum capacity of the compressor, FIG. 7 a diagram representing the control behaviour of the capacity control apparatus as used in FIG. 1, showing the value of a differential pressure over the capacity duty of the compressor, and FIG. 8 a view similar to FIG. 1 containing a second embodiment of a capacity control apparatus.
Figure 2:
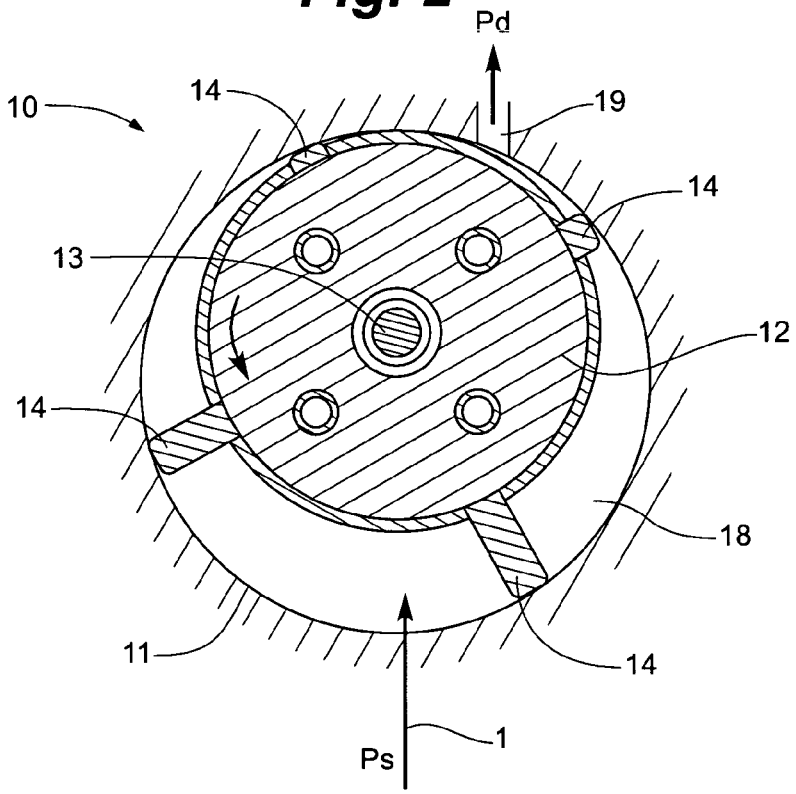
Figure 3:
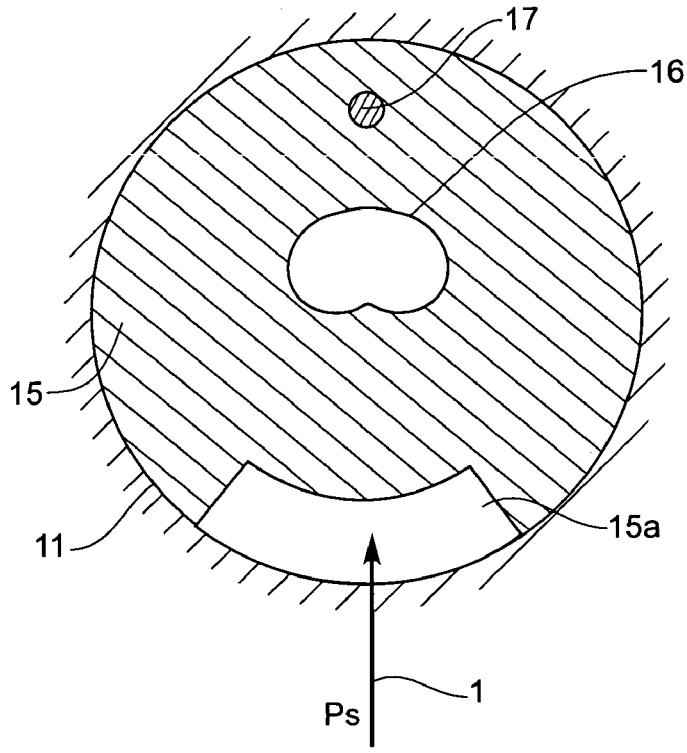

FIGS. 1 to 8 show a rotary compressor 10 with variable capacity in conjunction with a capacity controller 20 and a capacity variation mechanism 30, together employed in a refrigerating cycle of an automobile air conditioner or the like. The compressor 10 has (FIG. 2) a circular housing 11 receiving a somewhat smaller circular rotor 12 disposed on an eccentric axis 13. Said rotor 12 is driven e.g. by the engine of the automobile (not shown). In the outer periphery of rotor 12 radially displaceable seal pieces 14 are biased outwardly by spring means such that they contact the inner surface of housing 11. At the closest position between the inner surface of housing 11 and periphery of rotor 12 a discharge port 19 is provided discharging compressed high pressure refrigerant into a discharge pressure duct 2. An inhalation duct 1 for low-pressure refrigerant supplied from an evaporator (not shown) communicates with an inhalation port 15*a* of an inhalation port control board 15. Port 15*a* allows to supply the low-pressure refrigerant into a compression chamber 18 of compressor 10. Board 15 has axial and oversized bore 16 for eccentric axis 13.

The capacity of the compressor 10 can be varied by increasing or decreasing the volume, i.e. the angular extension, of compression chamber 18, e.g. by rotating the inhalation control board 15 in order to displace the inhalation port 15*a* in rotary direction. Control board 15 has a protruding driving pin 17 which can be adjusted about the axis of board 15 by capacity variation mechanism 30.

Figure 4:
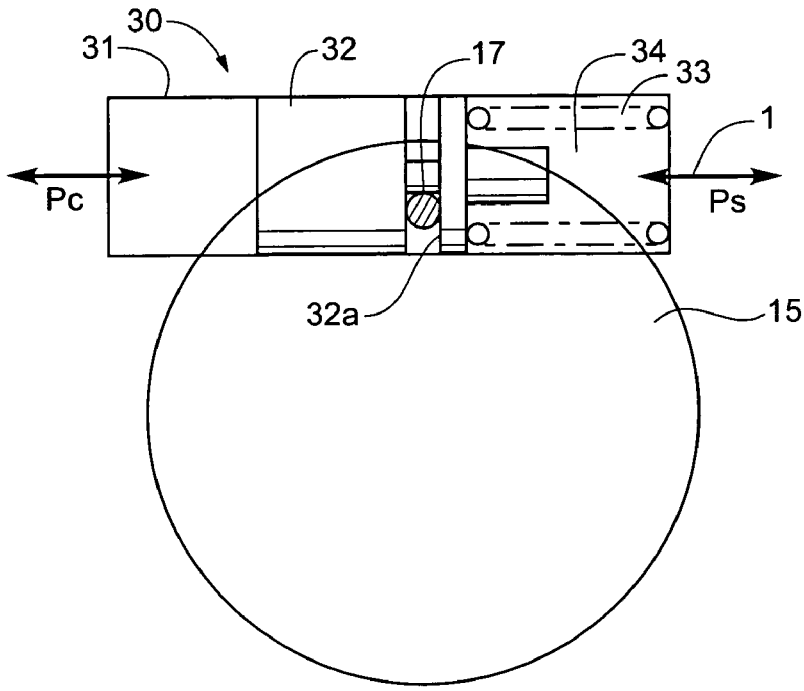

Mechanism 30 in FIG. 4 controls the position of the driving pin 17 in order to control the rotary orientation of the inhalation port 15*a* of control board. In a cylinder 31 of mechanism 30 a piston 32 is moveable in axial direction. Driving pin 17 engages into a circumferential groove 32*a* of piston 32. An axial movement of piston 32 automatically displaces control board 15 about its axis. Piston 32 is loaded by a spring 33 in a direction adjusting the capacity of the compressor towards a minimum. Spring 33 is received within one part of cylinder 31. Said part of cylinder 31 is also connected to inhalation duct 1 such that the pressure inside said part of the cylinder 31 correspond an inhalation pressure Ps of the compressor. The opposite part of cylinder 31 (at the other side of piston 32) is connected to a differential pressure port 28*c* of said capacity controller 20 which operates as a differential pressure controller. The pressure within the other part of cylinder 31 is a control pressure Pc the value of which is controlled by said controller 20. The higher said control pressure Pc is, the further piston 32 is displaced counter to spring 33 and the more control board 15 is rotated towards its position for maximum capacity of the compressor. The lower said control pressure Pc is, the more control board 15 rotated by spring 33 and inhalation pressure Ps towards its position of minimum capacity of the compressor 10.

Capacity controller 20, e.g. of FIG. 1, is a fixed differential pressure valve and includes a solenoid (coil 21, fixed iron core 22 and moveable iron core 23) for controlling said differential pressure also by the pressures at both ends of a piston valve body 25. The driving source of said solenoid is electromagnetic coil 21 to which electric current can be supplied upon demand (proportional solenoid, the actuation force of which directly is proportional to the value of current supplied to coil 21).

In addition springs 26, 27 are provided which act in opposite directions onto said piston valve body 25. The setting of both springs 26, 27 determines in the embodiment of FIG. 1 a basic maximum value of the differential pressure (Pc–Ps). Said value, however, can arbitrarily be decreased by feeding current into coil 21. The stronger the current is, the more moveable iron core 23 is attracted by fixed iron 22. Moveable iron core 23 causes a thrust F which is transmitted to said piston valve body 25 via a rod 24 extending along the axis of fixed iron core 20. Thrust F is acting in opening direction of said differential pressure valve of said controller 20 in FIG. 1.

Said inhalation duct 1 is connected to an inhalation pressure port 28*s* provided in a side of a housing of controller 20 and behind the back or rear effective pressure area of piston valve body 25 which can be loaded in the same direction by the thrust F of moveable iron core 23.

Piston valve body 25 co-operates by a front end valve closure jaw part 25*a* with a valve seat 42 provided between a space 41 housing piston valve body 25 and axially disposed a result, piston valve body 25 always axially and slightly moves and control pressure Pc is controlled to the fixed value, e.g. corresponding to the value of the electric current supplied to electromagnetic coil 21.

Figure 5:
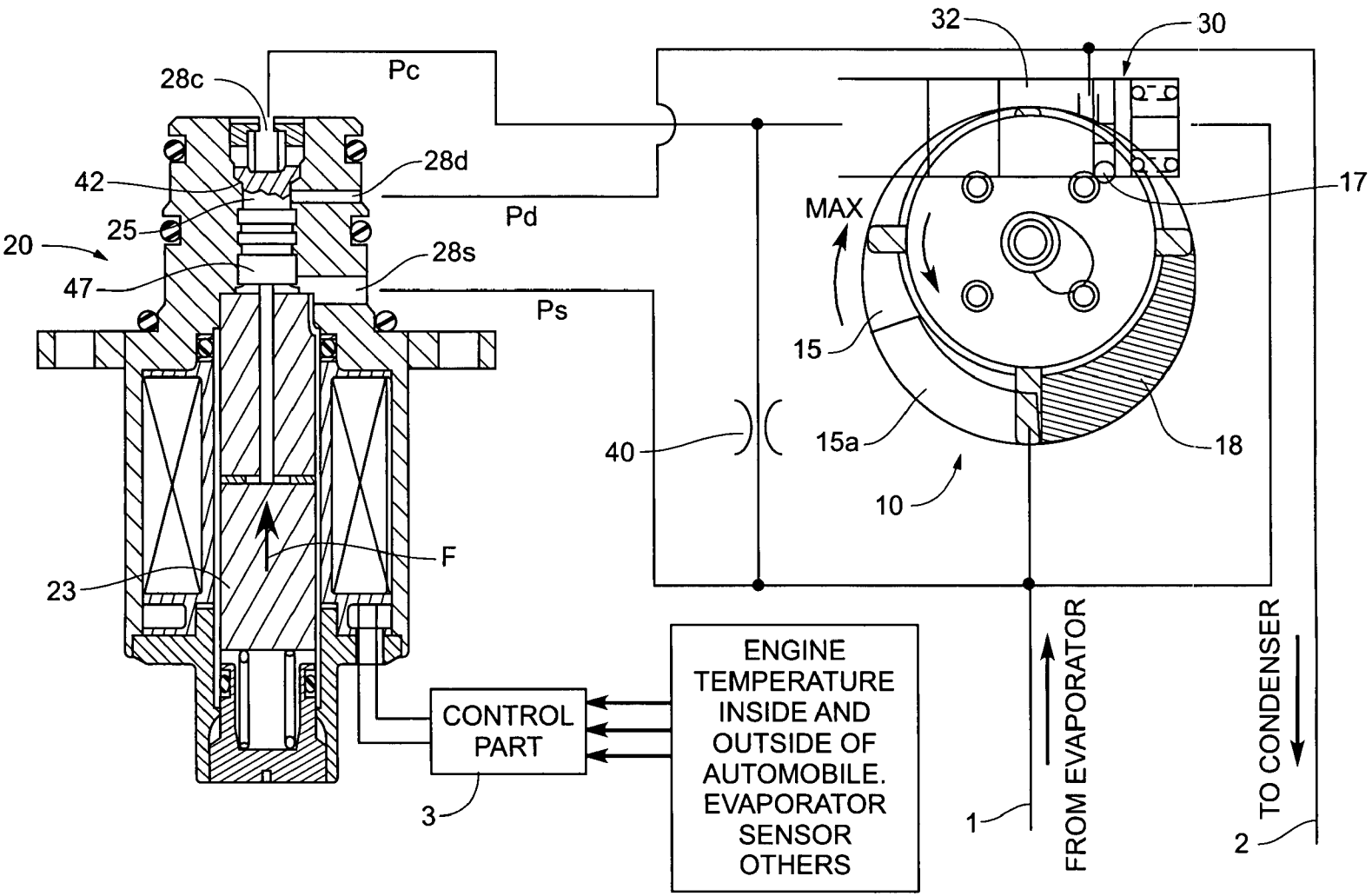

As shown in FIG. 5 the larger the value of the electric current in electromagnetic coil 21 is, the larger the pressure differential of (Pc–Ps) becomes, and the angular position of the inhalation port 15*a* is displaced in a direction towards (max) by capacity variation mechanism 30. As a result the capacity of the inhalation compression chamber 18 and consequently the discharge pressure Pd increase.

Figure 6:
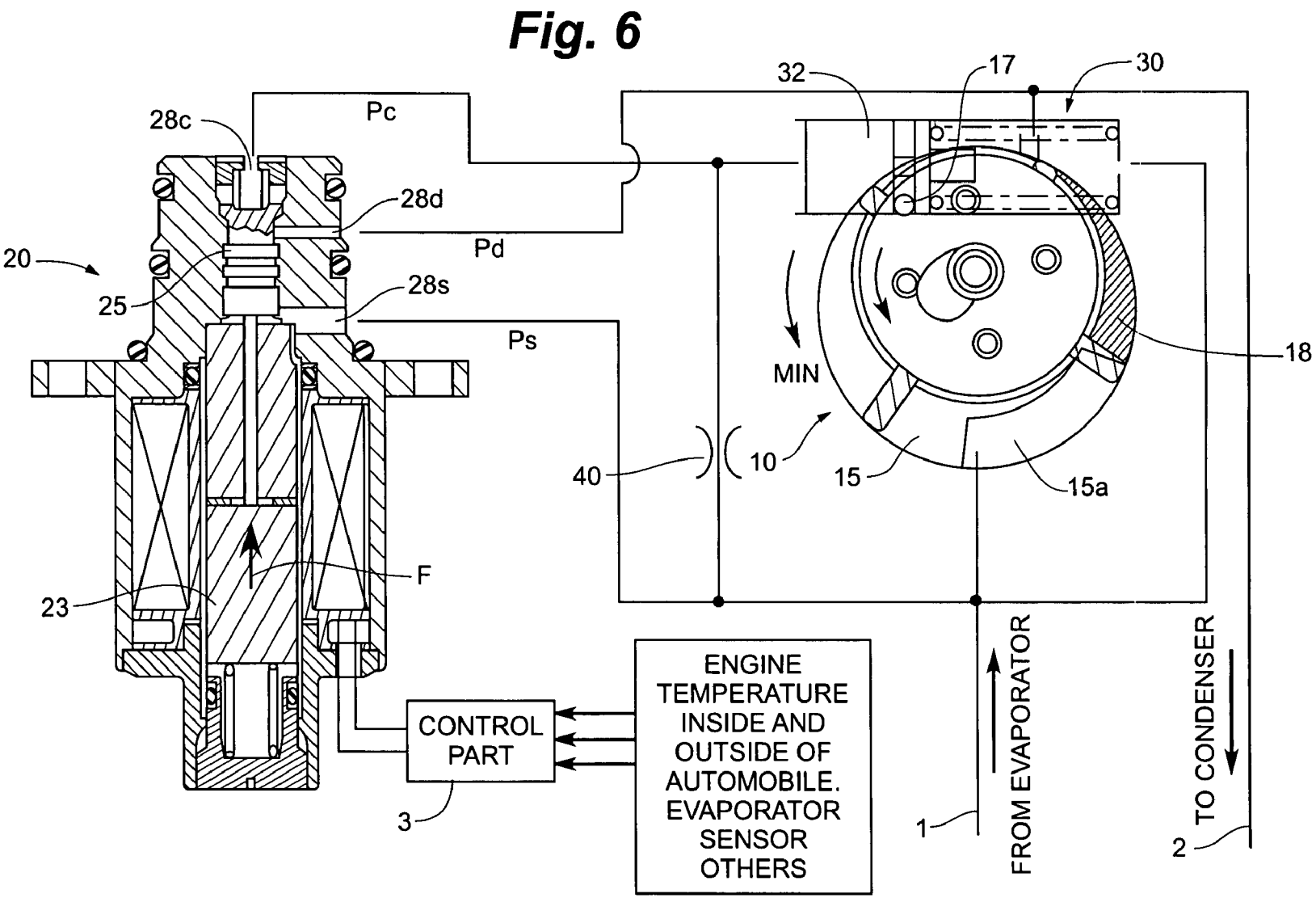

The smaller the value of the electric current in electromagnetic coil 21 is, the smaller is the differential pressure of (Pc–Ps), as shown in FIG. 6 and the angular position of inhalation port 15*a* is adjusted in the direction towards (min) by capacity variation mechanism 30. As a result, the capacity of said inhalation compression chamber 18 and the discharge pressure Pb both decrease.

Figure 7:
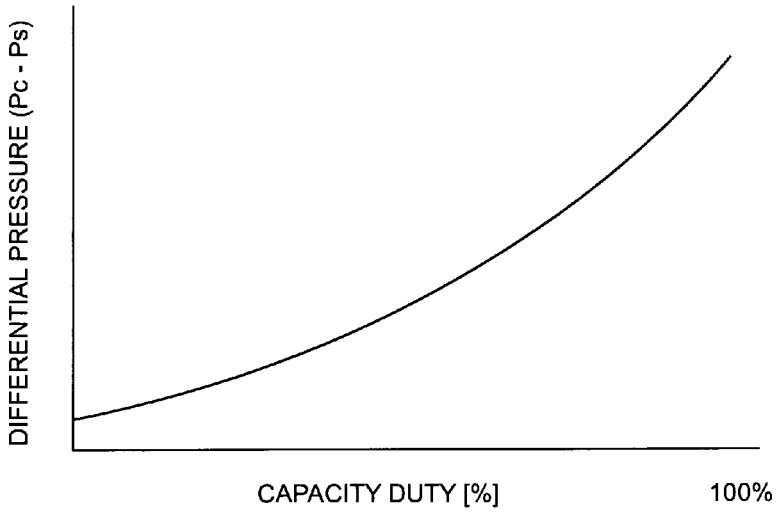
Figure 8:
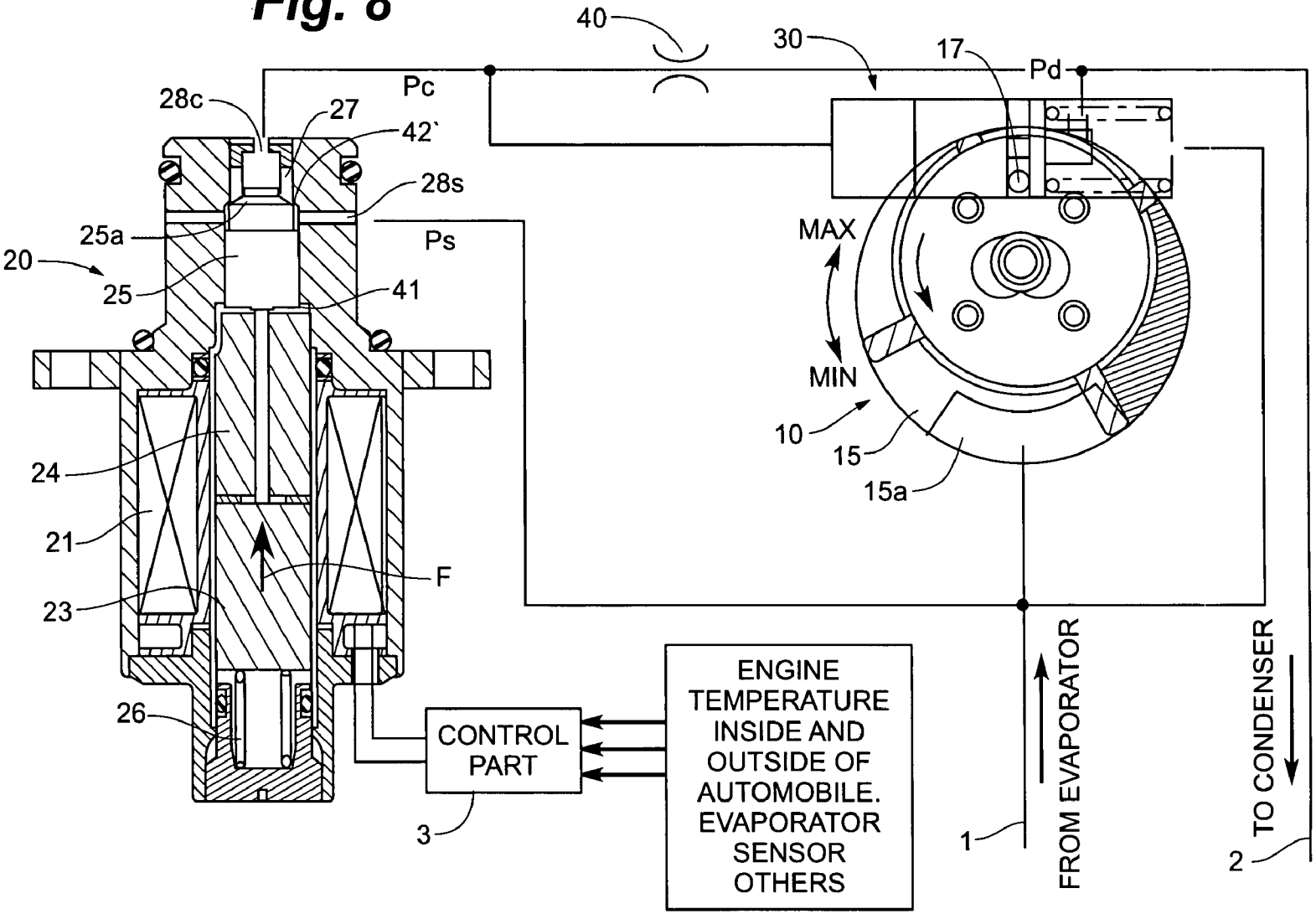

As can be seen in FIG. 7 the capacity of compression chamber 18 of compressor 10 is varied corresponding to the differential pressure Pc–Ps by controlling the value of the electric current in electromagnetic coil 21'.

The value of the electric current in electromagnetic coil 21 is controlled by inputting detected signals from an engine sensor, temperature sensors inside and outside of an automobile compartment, an evaporator sensor and a plurality of other sensors detecting specific kinds of conditions. Said signals are input into a control part 3 containing a CPU and the like. Said CPU processes the input signals and provides an output signal based on the respective operation results. The control signal is then output from control part 3 to electromagnetic coil 21, e.g. via a not shown driving circuit. In a second embodiment of controller 20 shown in FIG. 8 piston valve body 25 is co-operating with valve seat 42' such that said valve seat 42' is closed by the front end closure part 25*a'* in the direction of thrust F generated by solenoid 21, 22, 23. In this embodiment discharge pressure port 28*d* is omitted. At the very same location instead inhalation pressure port 28*s* is provided. Discharge pressure duct 2 directly is connected via leak passage 40 to the duct connecting differential pressure port 28*c* to the left part of cylinder 31 of mechanism 30. Inhalation pressure port 28*s* of the embodiment of FIG. 1 is omitted. Inhalation pressure Ps can act on piston valve body 25 in the same direction as thrust F, namely towards the closing state. The pressure in differential pressure port 28*c* is acting in opening direction.

Springs 26, 27 determine a basic value of differential pressure Pc–Ps. Said value can be increased arbitrarily by increasing the value of the current supplied to electromagnetic coil 21.

As soon as due to pressure passing leak passage 40 the pressure at differential pressure port 28*c* rises beyond the fixed value of the control pressure Pc, piston valve body 25 is lifted from its valve seat 42'. A flow communication is established between differential pressure port 28*c* and inhalation pressure port 28*s*. Control pressure Pc drops to the fixed value. As soon as the pressure at the differential pressure port 28*c* has reached the fixed value of the control pressure Pc, piston valve body 25 returns again into its closed state. Again high pressure refrigerant passes through leak passage 40 to differential pressure port 28*c* in order to maintain the fixed value of the differential pressure Pc–Ps as adjusted by the value of the current for the coil 21.

In both embodiments high pressure refrigerant from the discharge pressure duct 2 is used to build up the fixed pressure value for the control pressure Pc, however, influenced by the initial value of the inhalation pressure Ps.

The invention instead may be applied to control the capacity of a scroll compressor or the like instead of a rotary compressor 10 as shown.

What is claimed is:

1. A controller of a variable capacity compressor comprising:

a pressure controlled capacity variation mechanism connected to a solenoid actuated capacity controller, the capacity controller operable to generate a variable control pressure on the basis of an initial value of an inhalation pressure of the compressor and communicate the variable control pressure to the mechanism;

a valve seat disposed between a first valve chamber portion and a second valve chamber portion, a piston actuated valve closure device operable to open or close communication between a differential pressure port connected to a control pressure receiving portion of the mechanism and a discharge pressure port connected to a compressor discharge pressure duct; and a pressure responsive piston valve body loaded in a first direction of the piston actuated valve closure device by a spring force;

wherein the piston actuated valve closure device includes first and second pressure receiving portions, the first pressure receiving portion loaded in the first direction via an inhalation pressure port in the second valve chamber portion by the inhalation pressure of an inhalation pressure duct of the compressor, wherein the capacity controller includes a solenoid operable to generate a thrust force to actuate the piston actuated valve closure device relative to the valve seat, wherein the differential pressure port and the inhalation pressure port are interconnected by a leakage passage;

wherein the piston actuated valve closure device is disposed on a first side of the valve seat in the first valve chamber portion in communication with the differential pressure port and is unitarily formed at an end of the piston valve body, with the second pressure receiving portion loaded in a second direction towards the valve seat by the variable control pressure in the differential pressure port;

wherein the piston actuated valve closure device is slidably disposed within the second valve chamber part;

wherein the solenoid is operable to actuate the piston actuated valve closure device in the first direction of the piston actuated valve closure device when the solenoid is supplied with a current, a differential pressure between the variable control pressure and the inhalation pressure at the differential pressure port determined by the current; and wherein the differential pressure port is connected to a control pressure portion of a cylinder and increasing the variable control pressure at the differential pressure port operably adjusts the compressor capacity towards a maximum.

2. A capacity controller according to claim 1, wherein the differential pressure is proportional to the current supplied to the solenoid.

3. A capacity controller according to claim 1, wherein an adjustment range of pressure variations of the variable control pressure at the differential pressure port is wider than a range of pressure variations at the inhalation pressure port.

4. A controller of a compressor with variable capacity comprising:

a pressure controlled capacity variation mechanism connected to a solenoid actuated capacity controller, the capacity controller operable to generate a variable control pressure on the basis of an initial value of an inhalation pressure of the compressor and communicate the variable control pressure to the mechanism;

a valve seat disposed between a first valve chamber portion and a second valve chamber portion, a piston actuated valve closure device operable to open or close communication between a differential pressure port connected to a control pressure receiving portion of the mechanism and a discharge pressure port connected to a duct of the compressor; and a pressure responsive piston valve body loaded in a closing direction of the piston actuated valve closure device by a spring force, the piston valve body having first and second pressure receiving portions, the first pressure receiving portion loaded via the inhalation pressure of an inhalation pressure duct of the compressor in an opening direction of the piston actuated valve closure device relative to the valve seat;

wherein the differential pressure port and a discharge pressure duct of the compressor are interconnected by a leakage passage;

wherein the piston actuated valve closure device and the piston valve body are disposed at a first side of the valve seat in the second valve chamber portion in communication with an inhalation pressure port;

wherein the piston actuated valve closure device is unitarily formed at an end of the valve piston body with the first and second pressure receiving portions, the second pressure receiving portion loaded by the variable control pressure in the differential pressure port in the opening direction relative to the valve seat;

wherein the solenoid actuated capacity controller includes a solenoid operable to actuate the valve piston body in the closing direction of the piston actuated valve closure device when the solenoid is supplied with a current, a differential pressure between the variable control pressure and the inhalation pressure at the differential pressure port determined by the current; and wherein the differential pressure port is connected to the control pressure receiving portion of a cylinder of the mechanism and increasing the variable control pressure at the differential pressure port operably adjusts the compressor capacity towards a maximum.

5. A capacity controller according to claim 4, wherein the differential pressure is proportional to the current supplied to the solenoid.

6. A capacity controller according to claim 4, wherein an adjustment range of pressure variations of the variable control pressure at the differential pressure port is wider than a range of pressure variations at the inhalation pressure port.

* * * * *